United States Patent [19]

Eplett

[11] Patent Number: 4,696,476

[45] Date of Patent: Sep. 29, 1987

[54] MULTI-STEPPED GAMEBOARD APPARATUS

[76] Inventor: Gene W. Eplett, 108 Euclid Ave., Ardsley, N.Y. 10502

[21] Appl. No.: 861,153

[22] Filed: May 8, 1986

[51] Int. Cl.[4] ..... A63F 3/00

[52] U.S. Cl. ..... 273/241; 273/283; 273/285; 273/287; 273/DIG. 30

[58] Field of Search ..... 273/241, 287, 283, 260, 273/285; D21/23, 14

[56] References Cited

U.S. PATENT DOCUMENTS

| | | | |
|---|---|---|---|
| D. 210,542 | 3/1968 | Stookey . | |
| D. 215,103 | 9/1969 | Stevens . | |
| D. 221,390 | 8/1971 | Skillman | 273/241 X |
| D. 223,939 | 6/1972 | Palazzolo . | |
| 231,963 | 9/1880 | Luers . | |
| D. 267,023 | 11/1982 | Bowser . | |
| 511,306 | 12/1893 | Moore . | |
| 2,946,592 | 7/1970 | Post | 273/260 X |
| 3,406,975 | 10/1968 | Berger . | |
| 3,791,649 | 2/1974 | Gold . | |
| 3,809,407 | 5/1974 | Quigley . | |
| 3,847,397 | 11/1974 | Price | 273/283 |
| 4,093,236 | 6/1978 | Hoffa | 273/283 |
| 4,099,723 | 7/1978 | Robinson . | |
| 4,179,127 | 12/1979 | Goodman . | |
| 4,348,027 | 9/1982 | Escamilla-Kelly . | |

*Primary Examiner*—Richard C. Pinkham
*Assistant Examiner*—Matthew L. Schneider
*Attorney, Agent, or Firm*—Lilling & Greenspan

[57] ABSTRACT

A multi-stepped gameboard apparatus which is preferably made in a checkerboard design and divided into separate sections constructed in monotonic steps. The sections may be arranged in a variety of configurations to form a "mountain", "valley", or mixed mountain-valley configuration. Furthermore, the stepped gameboard sections are nestable to form an assemblage for carrying and storing the gameboard when not in use. Preferably, magnets or any other acceptable means known in the art are used to hold the sections together in the variable configurations. Storage areas for playing pieces are provided in each section.

12 Claims, 12 Drawing Figures

MULTI-STEPPED GAMEBOARD APPARATUS

FIELD OF THE INVENTION

The present invention concerns multi-stepped gameboards for games such as chess, checkers, backgammon, or any similar game. The stepped gameboards are separated into identical sections which may be joined together to form variable configurations and can be nested to form an easily carried or stored assemblage.

BACKGROUND OF THE INVENTION

Multi-leveled gameboards in a variety of forms are known in the art and have been used for a multitude of reasons. For example, a multiple tiered gameboard may have a futuristic look, be utilized to accommodate moving playing pieces or to emphasize various areas of the playing board.

More particularly, the board game of chess has remained immensely popular throughout the ages. Although a variety of chess boards have been invented to enhance the player's pleasure of the game, none of the gameboards known in the art have the novel construction of the present invention.

It is thus an object of the invention to provide a stepped gameboard which visually enhances the players' perception of the strategically important squares of the board by providing variable configurations simulating the terrain of a "battlefield".

This perception is achieved by steps on a playing surface which ascend to a central or controlled area forming a "mountain" configuration and providing players with the illusion of struggling upward for strategic control.

In another configuration of the gameboard, the steps are arranged to provide the illusion of struggling to control a lower central area located in the lowest plane of the gameboard to thus create a "valley" configuration.

To achieve the "mountain" and "valley" configurations, as well as, a mixed ascending-descending configuration, the gameboard is provided in four identical quadrants of a checkerboard surface which are arranged in a desired alignment of sections prior to the beginning of a game.

Furthermore, the sectioned and stepped checkerboard design of the gameboard permits the sections to be nested together to form a compact assemblage for easy carrying and storage. Storage areas provided in the gameboards may be used for storing playing pieces when not in use.

Additionally, the symmetrical and attractive design of the gameboard provides an aesthetically pleasing shape which may be enjoyed as an objet d'art or conversational piece when not in use.

SUMMARY OF THE INVENTION

All of the objects of the present invention along with others which are evident to those skilled in the art are accomplished by a sectioned gameboard having multi-tiered steps on one surface and having an opposing flat or level surface.

Each section of the gameboard is provided with a checkerboard design having alternating dark and light squares and the combined playing surfaces of all four sections has the number of squares of a conventional chess or checkerboard. The squares of the stepped playing surface of each section are arranged in seven levels or planes forming rows of monotonic steps. From corner to corner of each section, diagonal rows having squares of the same color form a 1-2-3-4-3-2-1 sequence.

Preferably, each of the sections of the gameboard are provided with a holding means, such as magnets, or any suitable material known in the art, to hold the sections together in a desired configuration.

In the preferred embodiment, the conventional checkerboard design having sixty-four (64 ) squares is arranged on each of the four sections providing four rows of four squares on each section, with each square differing in color from its right angle neighbor. The sections may be compactly stacked to form a rectilinear package. Additionally, the opposing sides of the multi-stepped surfaces provide a storage area for the playing pieces.

DETAILED DESCRIPTION OF THE INVENTION

Figure 1:
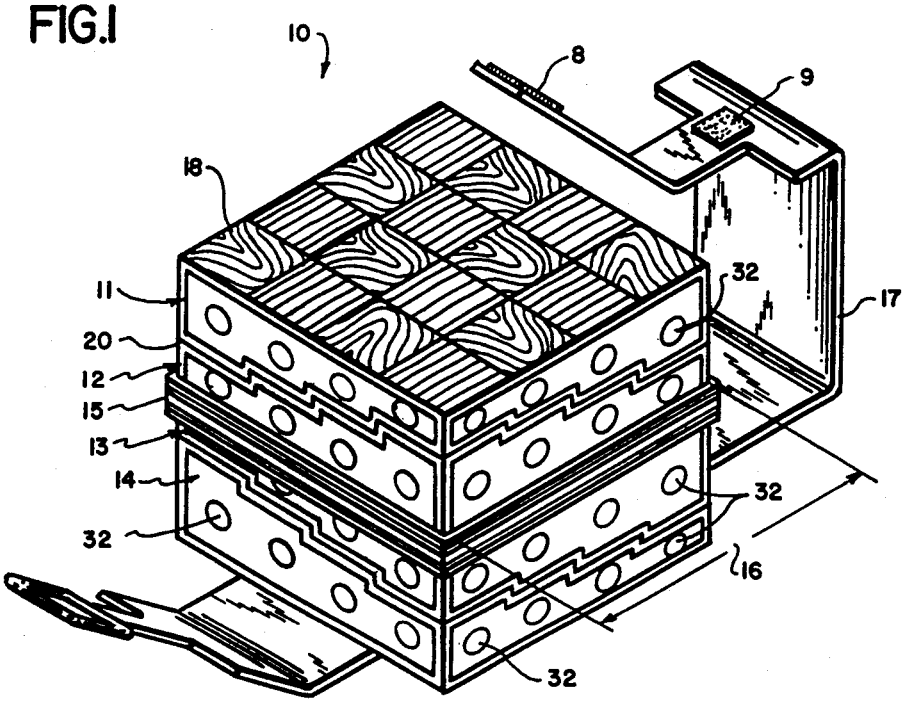
FIG. 1 is a perspective view of the stepped gameboard having its sections nested in a carrying or storage form.

As illustrated in FIG. 1, the inventive gameboard 10 is made of four similar sections 11, 12, 13, 14, which may be nested together to form a rectangular polyhedron which is substantially cubic. Stacking of the sections 11, 12, 13, 14 is assisted by a collar 15 and the entire assemblage may be held together by a belted strap 17, or any suitable means known in the art. Preferably, a Velcro® brand material closure consisting of minute nylon hooks 8 and loops 9 is attached to one end of the strap 17 to hold the assemblage and provide a carrying means.

Each section 11, 12, 13, 14 is preferably made of wood and has a checkerboard design on opposing sides 18, 20. Preferably, side 18 of each section is flat or planar, while the opposing side 20 has seven stepped levels. It may be appreciated that side 18 may accommodate any board game design in lieu of the checkerboard design such a backgammon, or other similar type of games.

Figure 2:
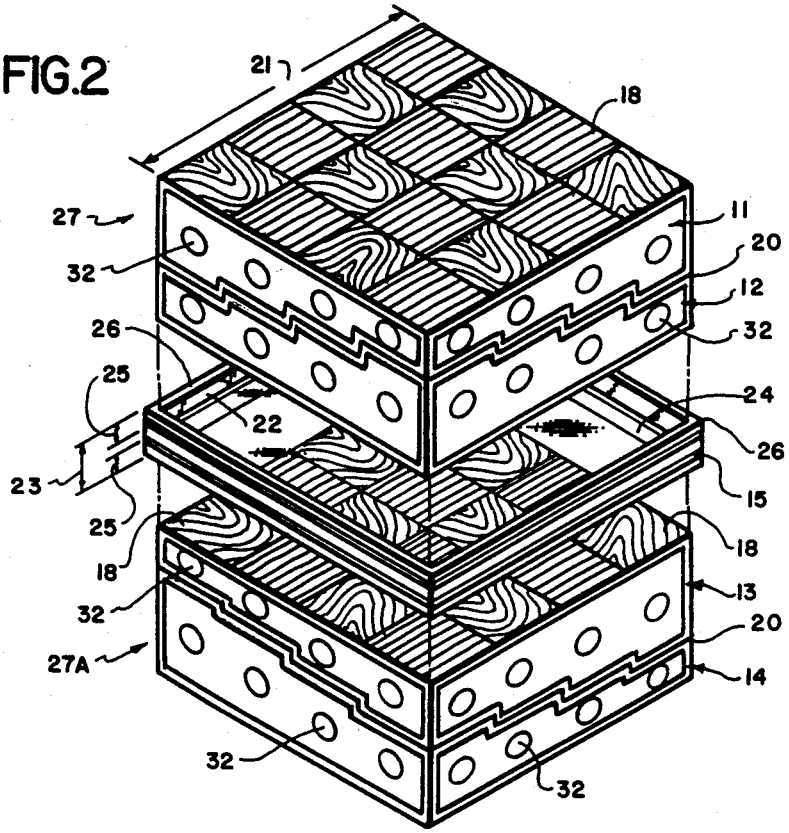
FIG. 2 is an exploded view of FIG. 1.

To disassemble the compact package and ready the gameboard for play, one separates the package into two groups 27, 27*a* of two nested sections 11, 12, 13, 14 each, as shown in FIG. 2. The collar 15 holding the two groups 27, 27*a* together can be removed from the assemblage at this point.

Figure 8:
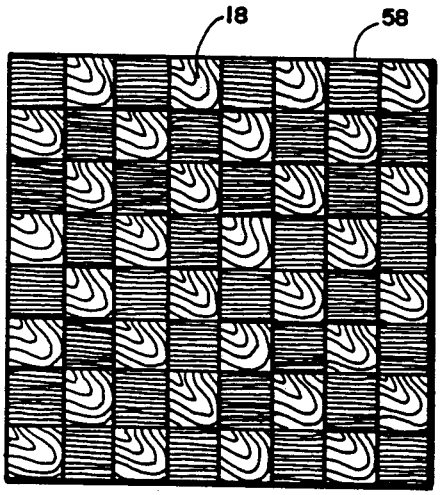
FIG. 8 is a top plan view illustrating the flat surface of the four sections arranged together as shown in FIG. 7.
Figure 8A:
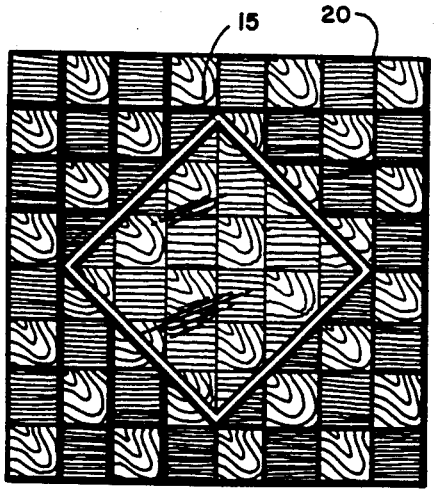
FIG. 8A is a bottom plan view illustrating the multi-stepped surface of the four sections arranged together as shown in FIG. 7, and further illustrating the position of the supporting collar.

Preferably, the collar 15 is a square frame having an inner perimeter 16 slightly larger than a outer perimeter 21 of the flattened sides 18 of the gameboard sections 11, 12, 13, 14. At approximately the midpoints 22 of the width 23 of the collar 15, a shelf 24 is inserted and attached to an inside perimeter of the collar 15. The shelf 24 may be made of any suitable material known in the art, however, a transparent glass or a plastic material is illustrated in FIG. 8A. Additionally, the depth 25 from the edge 26 of the collar 15 to the shelf 24 is substantially equal on both sides of the shelf 24, allowing the collar 15 to be used in assembling the sections without the need of determining a top or bottom side of the collar 15 prior to use.

As shown in FIG. 2, the four sections are grouped together in two groups 27, 27*a*. To form group 27, for example as illustrated in FIG. 2, the stepped sides 20 of sections 11, 12 are placed together by matching a highest step 35 with a lowest step 41 on diagonal corners of the sections 11, 12.

Figure 3:
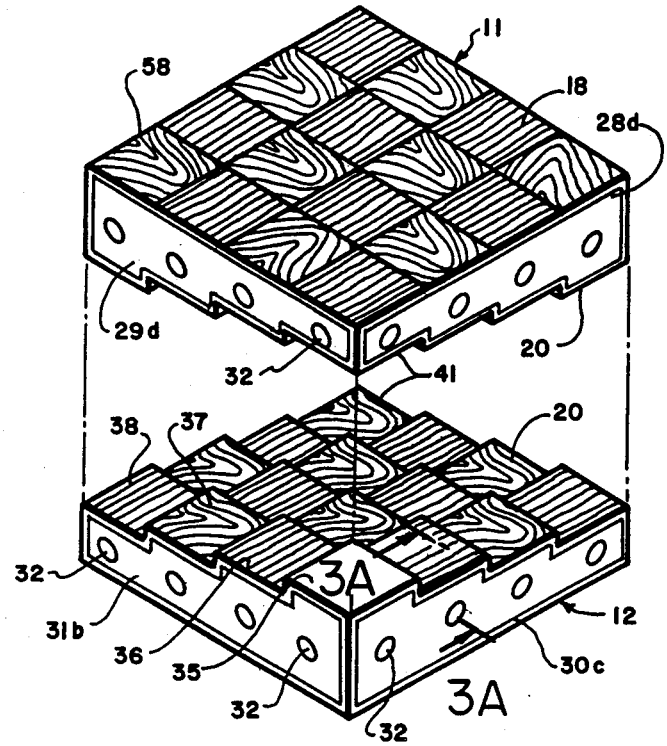
FIG. 3 is an exploded view of two sections stacked together as shown in FIG. 2.
Figure 3A:
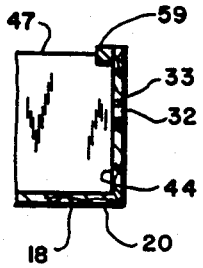
FIG. 3A is a cross-sectional view taken along lines 3A—3A of FIG. 3.
Figure 4:
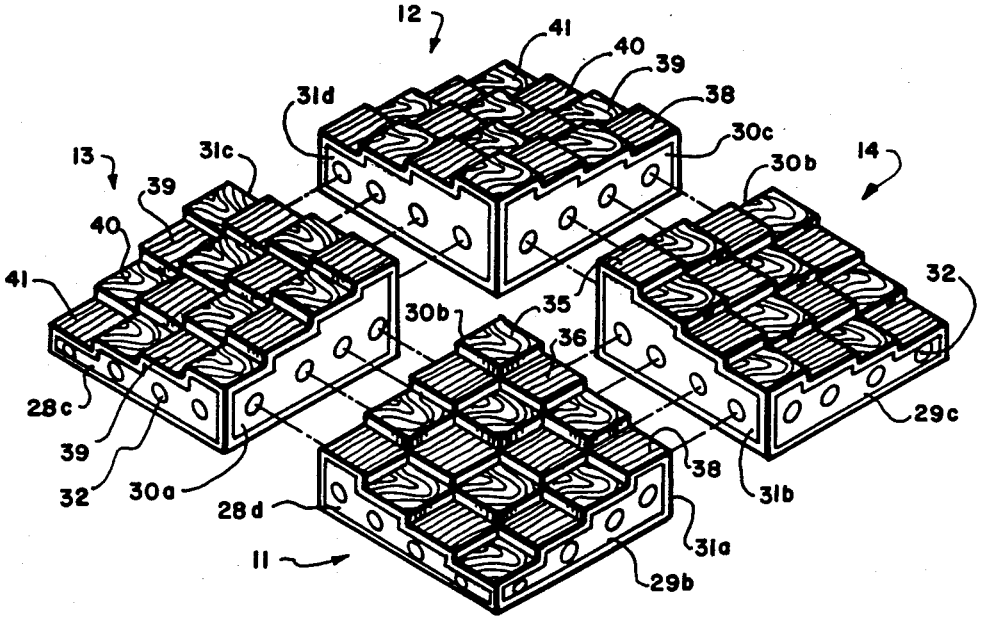
FIG. 4 is an exploded view of the four sections of the gameboard to be arranged in a "mountain" configuration.

To unnest the groups 27, 27*a* to arrange the sections to form the multi-stepped gameboard surface, one separates the sections 11, 12, 13, 14 and places each section on its flattened side 18 as illustrated in FIGS. 3 and 4. In this position, the sections may be joined together to form the desired configuration.

To form the desired configuration, the four sides 28*a*, 29*a*, 30*a*, 31*a* of each section are positioned. For example, to create the "mountain" configuration, one arranges the sections as shown in FIG. 4 by pairing side wall 31*a* of section 11 with side wall 31*b* of section 14, side wall 30*a* of section 13 with side wall 30*b* of section 11, side wall 31*c* of section 13 with side wall 31*d* of section 12 and side wall 30*c* of section 12 with side wall 30*d* of section 14. In the final configuration, the highest levels 35 of stepped squares, are joined together in the center 42 of the gameboard.

A means for holding the sections 11, 12, 13, 14 together may be provided if desired on each of the four eight sides 30*a*, 30*b*, 30*c*, 30*d*, 31*a*, 31*b*, 31*c*, 31*d* as illustrated in FIG. 4. In the preferred embodiment, magnets 32 are inserted in openings 33, such that the magnets in side wall 30*a* of section 13 are in a similar position in the side wall 30*b* of section 11 and the eight magnets will attract each other to hold the sections together. Magnets are the preferred means of holding the assembled four sections together to form the gameboard because when the sections are so held together, there will not be gaps between the sections in the final arrangement. It may be appreciated, however, that other means of holding this sections in an arrangement position may be used, such as strips of Velcro ® brand material, peg and hook arrangements, etc.

As noted in FIG. 4, the multi-stepped side 20 of each section preferably contains sixteen squares divided into diagonal rows having the arrangement 1-2-3-4-3-2-1 of squares. All of the squares in each diagonal row have the same color, while squares in adjacent diagonal rows have an opposite color forming a conventional "checkerboard" color pattern.

It may be appreciated that the squares of the checkerboard design may also have a circular, triangular, or any other shape or designation on them, other than colored squares.

Figure 5:
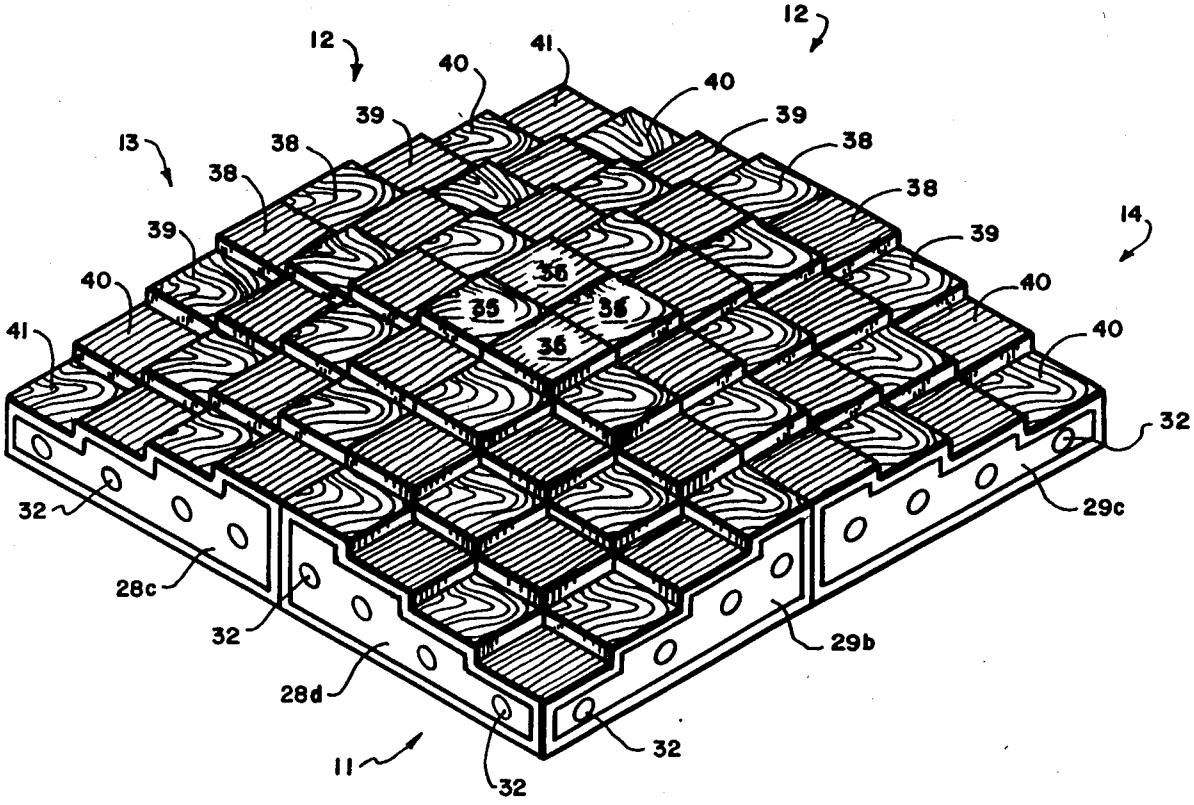
FIG. 5 is a perspective view of the gameboard illustrating the completed "mountain" configuration.
Figure 6:
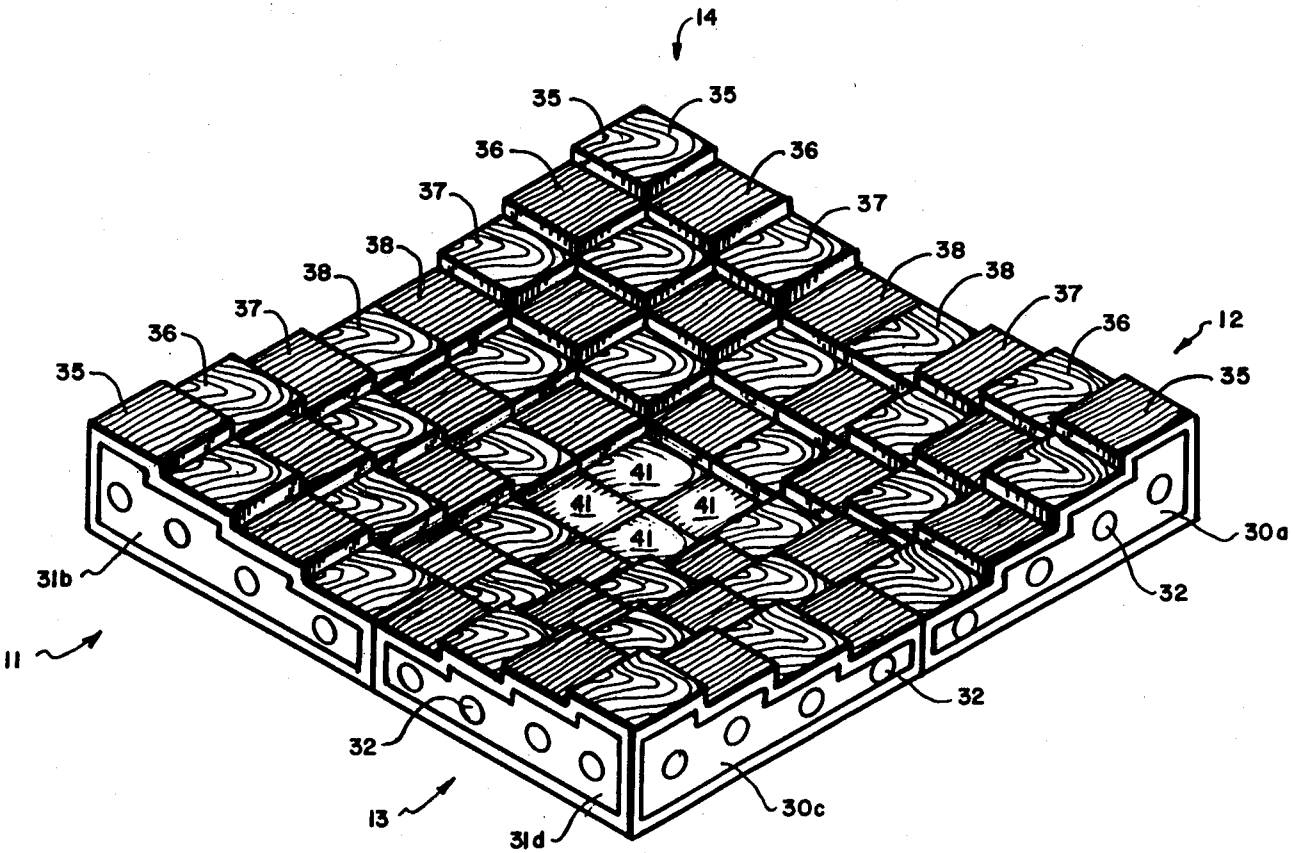
FIG. 6 is a perspective view of the gameboard in a "valley" configuration.

Additionally, the squares are stepped monotonically in rows such that each section has seven stepped levels 35, 36, 37, 38, 39, 40, 41 as illustrated in FIGS. 4–6.

The unique design of the seven stepped levels 35, 36, 37, 38, 39, 40, 41 permits a player to arrange the four sections 11, 12, 13, 14 in a variety of configurations to simulate various terrains of a plane or battle field. In one configuration as illustrated in FIG. 5 and discussed above, the highest levels 35 of each of the four sections 11, 12, 13, 14 may be arranged together in the center 42 of the game board 10 forming a "mountain" configuration in which the playing pieces moving to the strongest or center position of the chessboard move upward in position.

In contrast, as illustrated in FIG. 6, the lowest stepped levels 41 may be arranged together in the center 42 with the highest stepped levels 35 located at each of the four outer corners of the game board, such that the chess pieces move downward to a lowest position in the center 42 of the game board 10 and the gameboard 10 forms a "valley" configuration.

In both the "mountain" and "valley" configurations described above, the stepped levels 35, 36, 37, 38, 39, 40, 41 lie in planes proportional to their strategic value in the game of chess. Additional configurations not illustrated may be formed by rearranging the four sections 11, 12, 13, 14, in any desired configuration.

Figure 7:
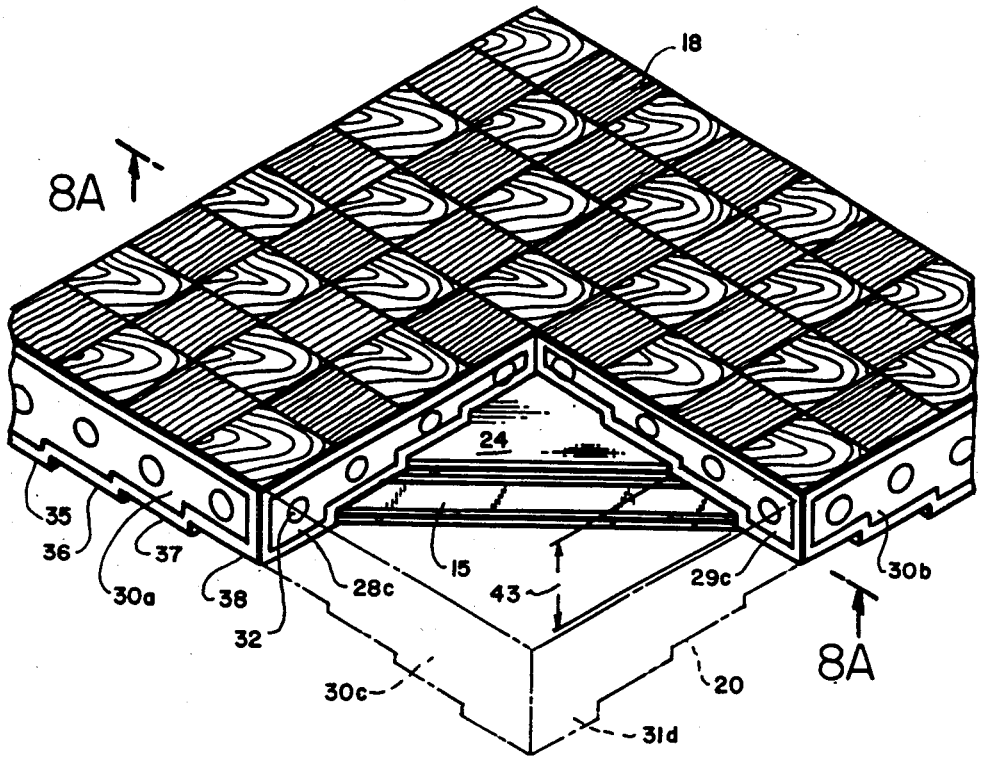
FIG. 7 is a perspective view, in partial section, illustrating the flat surface of the four sections arranged together forming a conventional checkerboard, the sections being supported by means of a collar.

If a player decides to use the flattened sides 18 of the sections 11, 12, 13, 14 for a gameboard for playing chess, checkers, or any other game requiring a flattened surface, the sections may be inverted and arranged together with the lowest stepped levels 41 near the center 42 and the highest stepped levels 35 at each of the four outer corners of the gameboard 10 as shown in FIG. 7. In this inverted "valley" arrangement, a flattened board surface is created as shown in FIG. 8.

Because of the uneveness of the multi-stepped sides 20 of the sections, it is necessary to brace the inner areas of the sections such that the height of the flattened gameboard is determined by the highest steps 35 of squares. Preferably, the collar 15 serves a dual function as a brace in achieving the desired arrangement. A view of the flattened gameboard illustrated in FIG. 7 from the multi-stepped surfaces 20 of the fours sections and also illustrating the collar 15 in a bracing position is shown in FIG. 8A. In the preferred embodiment and as illustrated in FIG. 7, the width 23 of the collar is substantially four times the depth 43 of each monotonic step providing stability to the gameboard 10 when the flattened surface configuration is assembled. It may be appreciated that any appropriately sized object may be used as a support to achieve the desired result.

Figure 9:
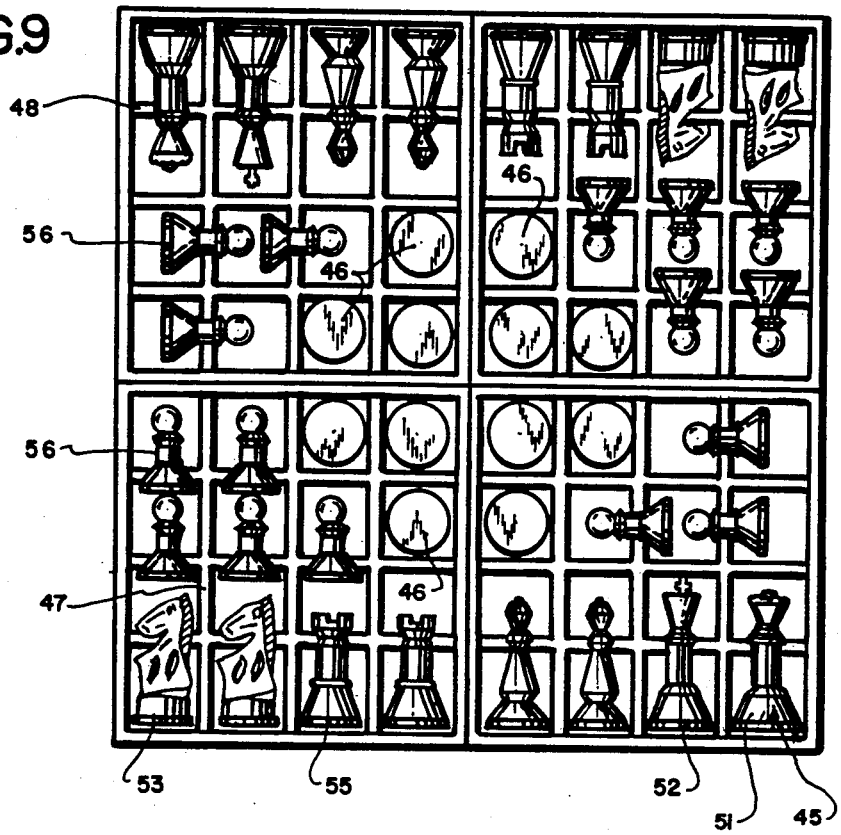
FIG. 9 is a plan view of the storage areas of the four gameboard sections with the storage cover removed, the sections positioned together as shown in FIG. 7 and the storage areas accommodating playing pieces.

Additionally, when the sections are arranged with their flattened sides 18 together to form a flattened surface of the gameboard 10, a player has easy access to a storage area 44 through the flattened side 18 of each section 11, 12, 13, 14. As shown in FIG. 9, the storage area 44 may be used for storing chess playing pieces 45, checker playing pieces 46 or any playing pieces which may be accommodated in the area. In the preferred embodiment, the storage area is divided by grid partitions 47 with an indenture 48 in a grid partition forming a grid square 50. The indenture 48 accommodates a chess playing piece to hold it snuggly within the grid square and keep the pieces from traveling around the storage area 44 when the sections 11, 12, 13, 14 are being carried or stored.

Figure 10:
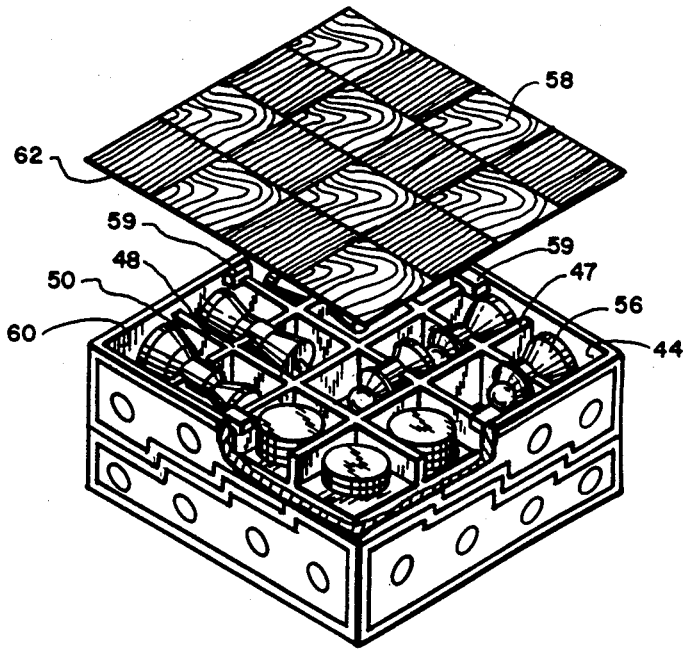
FIG. 10 is a partial exploded, perspective view of two sections of the gameboard nested together illustrating the removable cover, playing pieces and depths of the storage area of the upper section.

In the preferred embodiment as shown in FIG. 10, the depths of the grid squares 50 along the perimeters of the sections beneath the highest stepped levels 35, 36, 37, 38 of the multi-stepped side 20 of the section is greater than the depths of the grid squares 50 below the stepped levels 39, 40, 41. Thus, chess playing pieces such as the king 51, queen 52, knight 53, bishop 54, or castle 55, would best be accommodated in the deeper grid squares 50 beneath the highest stepped levels 35, 36, 37, 38. The shallower grid squares under the lower stepped levels 39, 40, 41 best accommodate chess pieces such as pawns 56 and checkers 46.

As shown in the exploded view of FIG. 10, the storage area 44 is preferably protected by a cover 58 accommodating the checkerboard squares on its outermost side. Although the lid 58 may be fitted over the storage area 44 in any manner known in the art, magnets 59 attached to the inner walls 60 of the storage area 44 are preferably used to attract opposing magnets or metal strips on the inner surface 62 of the storage area cover 58. Magnets are the preferred means of attaching the cover 58 to the storage are 44 because of the smoothness of the lines of the flattened sides 18 when the sections 11, 12, 13, 14 are arranged together to form the checkerboard or flattened board surface, however, it may be appreciated that any closure means known in the art may be used.

I claim:

1. A three-dimensional game board apparatus comprising at least four sections, each of said sections having at least one surface accommodating a checkerboard design and said surface constructed in seven planar levels having sixteen square steps in a monotonic arrangement, whereby said square steps in each diagonal row from one corner to a second corner of said section are of a similar color, said sections arrangeable n a variety of configurations and nestable forming a rectangular polyhedron, wherein there is one square step at a first planar level, two square steps at a second planar level, three square steps at a third planar level, four square steps at a fourth planar level, three square steps at a fifth planar level, two square steps at a sixth planar level and one square step at a seventh planar level, and said sixteen square steps descend from said first planar level to said seventh planar level.

2. A gameboard apparatus according to claim 1, wherein said rectangular polyhedron is substantially cubic.

3. A gameboard apparatus according to claim 1, wherein each of the four sections is substantially square shaped.

4. A gameboard apparatus according to claim 1, wherein each of said sections further comprises a means of fitting said sections together to form a configuration.

5. A gameboard apparatus according to claim 4, wherein said means comprises magnets symmetrically arranged in side walls of each of said sections and holding said four sections together forming a gameboard configuration.

6. A gameboard apparatus according to claim 5, wherein said configuration comprises an arrangement of the highest levels of said seven levels of each said separte section in a center area of said gameboard forming a "mountain" configuration.

7. A gameboard apparatus according to claim 5, wherein said configuration comprises an arrangement of the lowest levels of said seven levels of each of said separate together in a center area of said gameboard apparatus forming a "valley" configuration.

8. A gameboard apparatus according to claim 1, wherein said separate sections further comprise a storage area accommodating playing pieces.

9. A gameboard apparatus according to claim 1, wherein said sections are arrangeable to form a gameboard having a substantially planar playing surface and said apparatus further comprises a bracing means for bracing said apparatus on said stepped side and assisting in holding said sections together forming said planar playing surface.

10. A gameboard apparatus according to claim 9, wherein said bracing means aids in stacking said separate sections together and comprises a part of said rectilinear assemblage.

11. A gameboard apparatus according to claim 10, wherein said bracing means is a collar having a square-shaped shelf of rigid material.

12. A three dimensional game board apparatus comprising at least four sections, each of said sections having at least one surface accommodating a checkerboard design and said surface constructed in seven planar levels having sixteen square steps in a monotonic arrangement, whereby said square steps in each diagonal row from one corner to a second corner of said section are of a similar color, said sections arrangeable in a variety of configurations and nestable forming a rectangular polyhedron, and said sections arrangeable to form a gameboard having a substantially planar playing surface; and a bracing means for bracing said apparatus on said stepped side and assisting and holding said sections together forming said planar playing surface, said bracing means aiding in stacking said separate sections together and comprising a part of said rectangular polyhedron, and said bracing means including a collar having a square-shaped shelf of rigid material.

* * * * *